US010150611B2

(12) United States Patent
Cronacher

(10) Patent No.: US 10,150,611 B2
(45) Date of Patent: Dec. 11, 2018

(54) VESSEL HEAD AND TOOL AND METHOD FOR THE PRODUCTION THEREOF

(71) Applicant: Thielmann AG, Zug (CH)

(72) Inventor: Frank Cronacher, Weitefeld (DE)

(73) Assignee: THIELMANN AG, Zug (CH)

( * ) Notice: Subject to any disclaimer, the term of this patent is extended or adjusted under 35 U.S.C. 154(b) by 0 days.

(21) Appl. No.: 15/504,699

(22) PCT Filed: Aug. 19, 2015

(86) PCT No.: PCT/EP2015/069051
§ 371 (c)(1),
(2) Date: Feb. 17, 2017

(87) PCT Pub. No.: WO2016/026897
PCT Pub. Date: Feb. 25, 2016

(65) Prior Publication Data

US 2017/0259990 A1 Sep. 14, 2017

(30) Foreign Application Priority Data

Aug. 19, 2014 (DE) ..... 10 2014 111 810

(51) Int. Cl.
*B65D 88/12* (2006.01)
*B21D 22/20* (2006.01)
*B21D 51/18* (2006.01)

(52) U.S. Cl.
CPC ..... *B65D 88/128* (2013.01); *B21D 22/20* (2013.01); *B21D 51/18* (2013.01)

(58) Field of Classification Search
CPC ..... B65D 88/02–88/128; B21D 51/16–51/18; B21D 51/24; B21D 22/20–22/30
(Continued)

(56) References Cited

U.S. PATENT DOCUMENTS 3,780,901 A * 12/1973 Pechacek ..... A47J 27/0804 220/315
3,910,447 A * 10/1975 Bevilacqua ..... G21C 9/001 220/592
(Continued)

FOREIGN PATENT DOCUMENTS

DE 200 05 521 U1 10/2000
EP 0399099 A1 11/1990
(Continued)

OTHER PUBLICATIONS

International Search Report and Written Opinion dated Nov. 5, 2015 for Application No. PCT/EP2015/069051, 20 pgs.

*Primary Examiner* — Kareen Thomas
(74) *Attorney, Agent, or Firm* — Frost Brown Todd LLC

(57) ABSTRACT

The invention relates to a vessel head (1) for a vessel (30), comprising: a vaulted dish area (2) having a vault radius R, a connecting contour (5) comprising in a first contour section (6) a first radius of curvature (r1) and in a second contour section (7), a second radius of curvature (r2), wherein the first radius of curvature (r1) is larger than the second radius of curvature (r2) and a knuckle area (3) surrounding the dish area (2) and tracing the connecting contour (5) is configured between the connecting contour (5) and the dish area (2) comprising, extending along the first contour section (6), a first knuckle section (10) having a first knuckle radius (r1*k*1) and a second knuckle section (12) having a second knuckle radius (r1*k*2). The invention further relates to a tool and a method of manufacturing such a vessel head (1).

15 Claims, 8 Drawing Sheets

(58) Field of Classification Search
USPC ..... 220/1.5, 581–592, 560.04–560.15, 220/565–567.3
See application file for complete search history.

(56) References Cited

U.S. PATENT DOCUMENTS

| | | | | |
|---|---|---|---|---|
| 6,059,372 | A | 5/2000 | McDonald et al. | |
| 6,401,983 | B1 | 6/2002 | McDonald et al. | |
| 7,596,980 | B2 | 10/2009 | Kimura et al. | |
| 8,479,938 | B2 * | 7/2013 | Pu | B60P 3/2205 220/1.5 |
| 9,566,892 | B2 * | 2/2017 | Yielding | B60P 3/2215 |

FOREIGN PATENT DOCUMENTS

| | | | |
|---|---|---|---|
| EP | 0970764 | A1 | 1/2000 |
| WO | WO 2016/026897 | A1 | 2/2016 |

* cited by examiner

VESSEL HEAD AND TOOL AND METHOD FOR THE PRODUCTION THEREOF

FIELD OF THE INVENTION

The present invention relates to a vessel head and a tool and to a method for the production thereof.

BACKGROUND OF THE INVENTION

In tank and apparatus construction, various vessel heads are known. Vessel heads tend to be vaulted sheet metal elements which serve to close the ends of usually cylindrical vessels or to subdivide the same into a number of compartments.

The actual vessels are usually cylindrical in shape, showing different cross-sections (e.g. circular, elliptical, dual-shell, quadruple-shell, box-shaped). The outer vessel wall is formed of one or more curved sheet metal element(s) (manufactured by rolling), showing a tubular shape and the pertaining cross-sectional geometry. The ends of such a shell ring are closed with suitable vessel heads. To this end the vessel heads are usually welded to the shell ring. To this end the vessel head comprises a connecting contour corresponding to the shell ring so that the shell and the head abut one another at their respective connecting contours and they can be connected with one another by way of a butt seam that is advantageous in terms of manufacturing and strength. There are connecting configurations where the vessel head is pushed into or onto the shell ring and the two components are connected by way of a so-called fillet weld. Other than cylindrically formed vessel rings there are also truncated-cone configurations.

The vessel heads show as a rule a cylindrical respectively conical rim or straight flange which makes a transition via a comparatively narrowly curved (torically vaulted) knuckle area to a flatter—often spherical—vaulted dish area forming the majority of the surface of the actual head.

In the case of vessels showing circular cross-sections, so-called torispherical dished heads are usually used which show a dished head shape according to DIN 28011, a torispherically dished head shape according to DIN 28013 (type: Korbbogen), or which are configured as an elliptical head respectively a normal/slightly vaulted head.

These heads tend to be manufactured in a two-stage process where—starting out from a flat sheet metal disk (circular or sheet blank)—first the spherical vault is formed in a pressing process (dishing) and thereafter the knuckle area and the so-called straight flange are integrally formed in a pressing process (flanging). Thin-walled heads may also be manufactured completely in one pressing process (usually deep drawing).

Manufacturing these vaulted heads is particularly challenging for non-circular tank cross-sections. These heads are known e.g. from DE 200 05 521 U. For one, the largely mechanised dishing and flanging processes for circular cylindrical heads cannot be employed. What is particularly difficult is integrally flanging, integrally forming the knuckle area and the straight flange. For another, the usual head shapes where a uniform vault radius makes a transition to a uniform knuckle radius in the dish area are suitable only to a limited extent for pressing and in particular deep-drawing processes since the shapes of non-circular vessel cross-sections show different and asymmetrical curve shapes which, together with the productional, asymmetrical strengths of rolled metal sheets may result in deformation anomalies. These may include creases, dents, and unintentional thinning or thickening in the starting material generated in the deformation process. Therefore these heads are manufactured in complex, manual shaping processes or joined together from prefabricated component parts. An end head area assembled from component parts for a transport vessel is e.g. known from EP 0 399 099 A.

For reasons of quality and efficiency it is therefore desirable to manufacture these kinds of heads—for example for elliptical, box-shaped or other, asymmetrical cross-sections—having differently contour curves in a defined tool with reproducible geometry to ensure the precisely fitting connection with shell rings likewise produced, without complicated refinishing work. There is a particular need in particular for deep-drawn vessel heads showing a wall thickness of more than 2 mm and suitable for vessel cross-sections having diameters in the magnitude of more than 500 mm in one axial direction and more than 1000 mm in another axial direction and which, given a narrow knuckle radius of about 50 to 75 mm, show a vault depth of more than 250 mm.

These vessel heads cannot be manufactured with simple deep-drawing processes (one-stage) at all or at best showing the quality defects indicated above. Although multi-stage deep-drawing processes where the desired geometry is configured in steps in multiple different tools and in multiple method steps may be suitable, they are economically feasible only in an industrial scale (in thousands).

Therefore there is the object to provide a non-round vessel head which can be manufactured in a one-stage deep-drawing process even given a relatively high wall thickness and comparatively large dimensions, and the final geometry of which can be manufactured with high repeating accuracy and narrow tolerances with a suitable method and using a suitable tool.

SUMMARY OF THE INVENTION

This object is solved by a vessel head according to claim 1, a deep-drawing tool according to claim 10 and by the method according to claim 11 respectively.

The vessel head according to the invention comprises a vaulted dish area having a vault radius R, a connecting contour showing in a first contour portion a first radius of curvature and in a second contour portion a second radius of curvature, wherein the first radius of curvature is larger than the second radius of curvature and a knuckle section surrounding the dish area and tracing the connecting contour is configured between the peripheral contour and the dish area, comprising a first knuckle portion having a first knuckle radius and a second knuckle portion having a second knuckle radius, wherein the first knuckle radius is larger than the second knuckle radius.

The variations of the knuckle radius in one single contour portion showing a flatter curve (larger radius of curvature) optimise the deformation conditions for a deep-drawing process in this region. The material flow is improved such that largely wrinkle-free transitions can be realised between all the deformed surfaces, in one single deep-drawing process by means of a suitable sheet blank (circular blank) by means of a deep-drawing tool comprising a die, a deep-drawing frame and a blank holder and optionally a counterplate. The die geometry corresponds to the vessel head geometry.

In this conjunction the term "deep-drawing" indicates both the actual deep-drawing where the metal sheet thickness remains approximately constant over the drawn part, thus the surface of the sheet blank matches the surface of the drawn part (vessel head), and also the so-called stretch drawing where the drawn part is shaped by a (partial) expansion of the surface while the sheet thickness decreases.

The shaping according to the invention also enables improved pressure resistance (internal excess pressure acting on the concave wall section of the vessel head) so as to increase the suitability of such a vessel head for a pressure vessel. This allows to reduce the minimum wall thickness and thus the weight and price (material costs) of the head while ensuring the same stability. Moreover the tension transitions in the flat curved cylindrical shell section can be configured smoother.

Further aspects and features of the present invention ensue from the dependent claims, the enclosed drawing and the following description of preferred embodiments.

BRIEF DESCRIPTION OF THE DRAWING

Embodiments of the invention will now be described by way of example and with reference to the accompanying drawing. It shows in.

DESCRIPTION OF EMBODIMENTS

Figure 1:
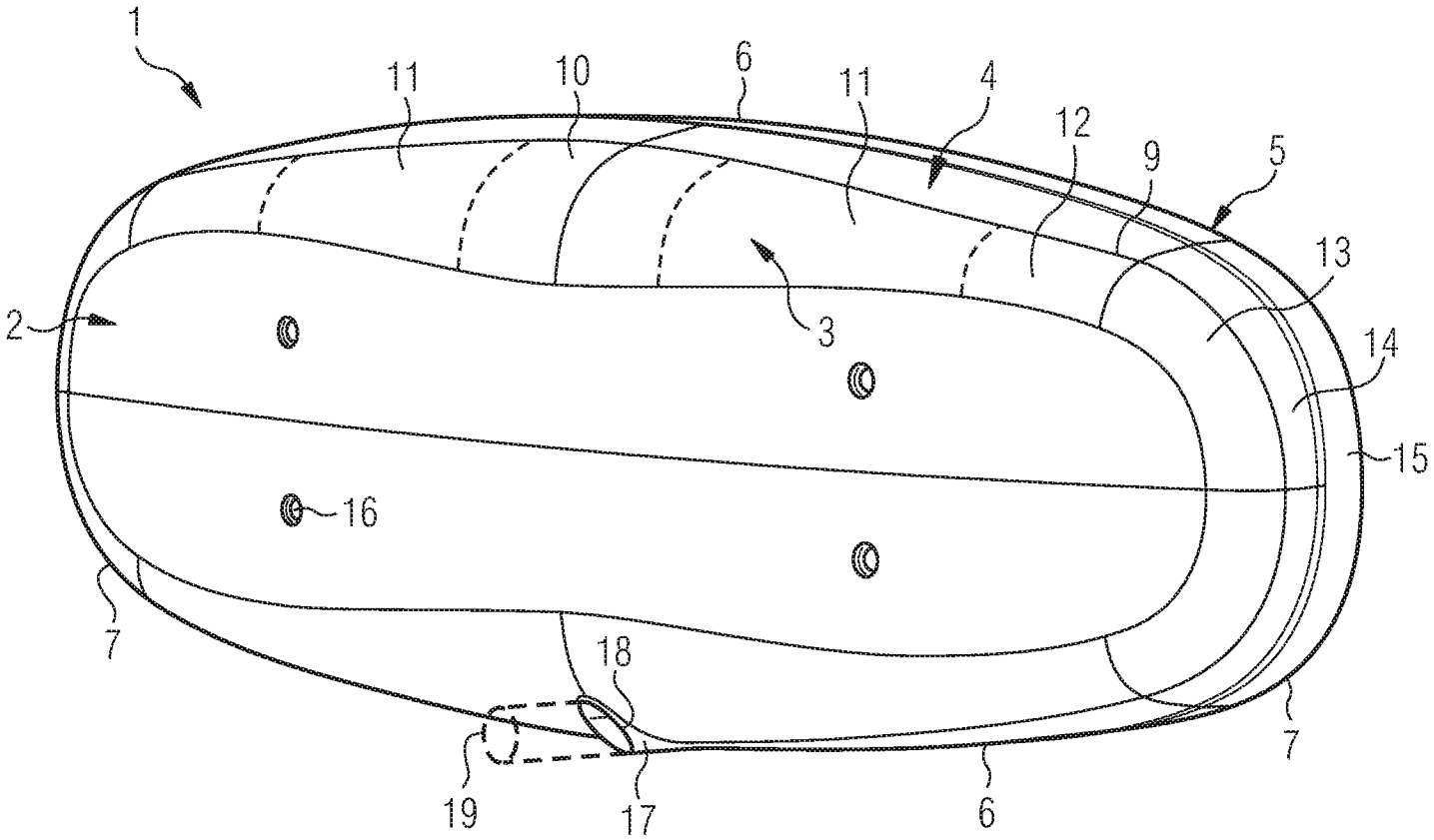
FIG. 1 a perspective view of a first exemplary embodiment of a vessel head according to the invention, FIG. 2 a sectional view of the vessel head in FIG. 1, FIG. 3 a perspective view of a second exemplary embodiment of a vessel head according to the invention, FIG. 4 a sectional view of the vessel head illustrated in FIG. 3, FIG. 5 an upright vessel having a vessel head according to the invention, FIG. 6 a tank container arrangement with a vessel disposed horizontal with a vessel head according to the invention, FIG. 7 a perspective view of a blank part formed by way of a deep-drawing process for a vessel head according to FIGS. 1-4, and FIG. 8 a schematic process flow of a method according to the invention for manufacturing a vessel head according to the invention.

FIG. 1 illustrates an embodiment in accordance with the present invention. A detailed description will now follow general explanations on the embodiments.

In conjunction with this application the term "vault" is used so as to mean a surface showing curves in multiple axes, as in a spherical shape. Whereas the term "curve" denotes a surface curved in one axis, as in a cylinder shape.

Furthermore the following specific meaning applies with regard to the knuckle area of a head which is vaulted according to the definition above where the knuckle area shows (optionally different) curves. For one, the curve that is indicated by the so-called knuckle radius or the knuckle curve. This knuckle radius lies in a sectional plane that is normal to the knuckle or head surface, indicating the curve of the knuckle area in this plane. In the case of a circular knuckle area the knuckle surface describes a torus or a section of a torus respectively (enveloping surface forming a circle contour when being displaced along a ring extending through its centre). When this curve defining the torus is not circular but includes differently curved regions—as is the case is non-circular vessel or head cross-sections—then the body generated by the knuckle radius is for one, provided with the one curve corresponding to the knuckle radius and for another, it is curved corresponding to the curve of the generator.

There are embodiments where the first knuckle section (having a flatter curve) is arranged between two knuckle sections having a narrower curve so that the knuckle radius does not abruptly change but transition sections are formed between the first knuckle section and the second knuckle section where the first knuckle radius makes a transition to the second knuckle radius. This further contributes to forming head structures that are optimised in terms of pressures and manufacturing.

In another embodiment a third knuckle section comprising a third knuckle radius is provided along the second contour section (having a narrower curve). There are embodiments in which this third knuckle radius is configured identical to the second knuckle radius. In other embodiments the third knuckle radius may be smaller than the second knuckle radius. There are further embodiments in which transition sections are also formed between third knuckle sections and adjacent, second knuckle sections so that again, knuckle surfaces showing different curves show smooth transitions.

Vessels used for example for storing and transporting liquids tend to require a connection in the base region of the vessel through which the vessel can be emptied without leaving residue. In the case of horizontal vessels this connection suitable for complete emptying needs to lead tangentially into the base of the cylindrical shell. To provide a suitable pipe connection namely, in the knuckle area of the vessel head, a comparatively large cutout needs to be provided the contour of which is formed by way of the intersection line of a pipe leading tangentially into the vessel. This intersection contour is comparatively complex and may present problems in terms of pressures and manufacturing technology. Moreover the connection requires a relatively long weld seam for welding a suitable pipe connection into the vessel head.

Therefore there are embodiments where the first, second, and/or third knuckle sections—depending on the vessel position—where a connection region is formed comprising a connecting contour that describes a circular cylinder section, in particular an oblique circular cylinder section. Such a connection region may be formed in a suitable deep-drawing process by way of a suitable configuration of the pressing tool. A connecting pipe to be connected thereto also only requires to be cut off obliquely without requiring a complex cutting contour as a direct connection to the vessel knuckle would require.

The connection region may be configured so as to be suitable both for a lying (showing a horizontal longitudinal axis) and also an upright vessel (showing a vertical longitudinal axis). Then the connection region needs to be configured so that it leads for one, starting tangentially from the connecting contour—optionally with suitable fillets—into the collar or straight flange of the vessel head (horizontal arrangement of the vessel) and/or tangentially into the lowest point of the dish area of the vessel head (vertical arrangement of the vessel). If a connection must be provided, the connection region only needs to be cut out in the region of, and tracing, the connecting contour. Then a suitable, obliquely cut-off pipe may be connected.

There are embodiments where the first knuckle radius is 1.5 to 3 times the second knuckle radius, in other embodiments, 1.8 to 2.5 times, and there are also embodiments where it is 2 times the second knuckle radius. These ratios have been tried and tested as regards manufacturing and configuration in terms of the pressure of these vessel heads. They allow an advantageous configuration in terms of manufacturing and/or in terms of pressures or else an advantageous configuration in view of the structural strength of the vessel in the knuckle area which may optionally be connected with supporting structures in this region, optionally via intermediate components.

In other embodiments the following correlation exists between the vault radius and the first radius of curvature. Their relationship to one another is 2.6 to 1 up to 1:1. In other cases a range of 1.5:1 to 1:1 is provided, and there are embodiments where a relationship of 1.2:1 to 1:1 is provided. This measure allows to realise different flat (e.g. oval, dual-shell, or box-shaped) vessels and a great variety of vessel geometries which are optimised either as regards the available spatial volume or the pressure resistance.

There are embodiments where the first knuckle radius and the vault radius are provided in a relationship of 1:10 to 1:50, in other embodiments a range of 1:20 to 1:30 is provided, and in other embodiments the relationship is 1:25. Again, the relationships between the vault radius (the dish) and the knuckle radius may be configured in view of different requirements as regards pressures or in view of volume optimisation (narrower curve radii/knuckle radii).

There are embodiments where the shape depth or vault depth T (corresponds to the "head height" from the connecting contour to the dish crest) is 3 to 5 times the second knuckle radius, in particular 3.5 to 4 times, and specifically 3.75 times.

There are embodiments where a frusto-conical and/or cylindrical straight flange area is formed between the connecting contour (to the vessel shell) and the knuckle area. For forming a frusto-conical knuckle area the connection diameter (or the connection diameter relationships) may be varied by way of cutting a suitably manufactured blank head in different heights (different knuckle heights) so that the remaining knuckle area is configured at different lengths/heights. For a short knuckle area the diameter is smaller, for a long knuckle area, correspondingly larger.

There are also embodiments where sections of a cylindrical knuckle area and a frusto-conical knuckle area are provided looking in the peripheral direction. This embodiment may offer advantages in terms of manufacturing since the deformation properties can be improved in particular in the heavily reshaped rim areas.

Vessel heads according to the invention are formed from a ductile metal material suitable for forming, in particular from a standard stainless steel material (e.g. in the qualities 1.4301, 1.4404; 1.4571).

In the case of box-shaped, oval or approximately elliptical vessel cross-sections the diameter ratio (larger to smaller diameter, width to height for a horizontal vessel; width to depth for an upright vessel) is 2:1 to 3.5:1, in particular 3:1.

Another aspect of the invention relates to a deep-drawing tool, in particular a die, for manufacturing a vessel head according to the invention.

Another aspect relates to a method for manufacturing a vessel head according to the invention comprising the steps of: Providing a circular metal blank (sheet blank), forming the circular metal blank by means of a deep-drawing tool to obtain a deep-drawing intermediate product and trimming a deep-drawing intermediate product along a peripheral contour which peripheral contour is configured by a number of contour cuts performed successively. This method contributes to perform the desired connecting contour or peripheral contour of the vessel head with high repeating accuracy and narrow tolerances. Optionally the method may also comprise configuring a connection port in the deep-drawing intermediate product or in the vessel head respectively.

Figure 2:
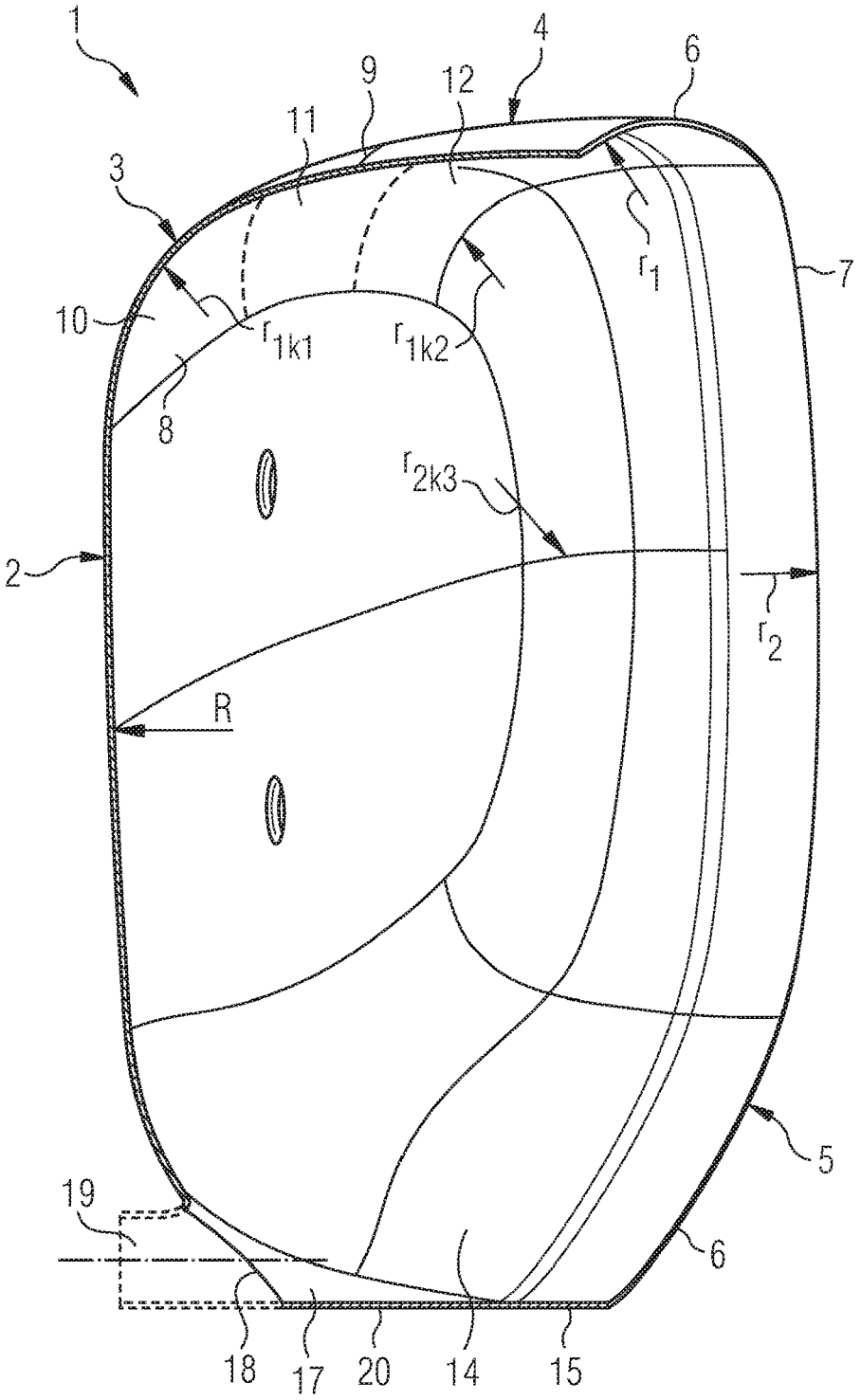

Returning to FIGS. 1 and 2, these show a first exemplary embodiment of a vessel head 1 according to the invention comprising a vaulted dish area 2 having a vault radius R. The dish area 2 makes a transition via a knuckle area 3 to a straight flange area 4 terminating in a connecting contour 5 corresponding to the vessel cross-section.

The connecting contour 5 shows in the crest and head areas a flat, curved, first contour section 6 having a first radius of curvature $r_1$. The two first contour sections 6 are interconnected via second contour sections 7 showing narrower curves in the flank regions which show a radius of curvature $r_2$ with the connecting contour 5 extending smoothly over the first and second contour sections 6 and 7.

The knuckle area 3 surrounding the dish area 2 follows the dish area 2 with its dish-side rim 8 and with its connection-side rim 9 adjoins the straight flange area 4 which is optionally configured between the knuckle area 3 and the connecting contour 5. In an embodiment where no straight flange area 4 is provided the connection side rim 9 also forms the connecting contour 6.

In the range of the first contour sections 6 the knuckle area 3 comprises a first knuckle section 10 having a knuckle radius $r_{1k1}$. This first knuckle section 10 makes a transition through an optional transition section 11 to a second knuckle section 12 having a second knuckle radius $r_{1k2}$. The second knuckle section 12 abuts a third knuckle section 13 extending in the range of the second contour section 7 and has a third knuckle radius $r_{2k3}$.

The optional straight flange area 4 extending between the knuckle area 3 and the connecting contour 5 in the illustrated exemplary embodiment comprises a frusto-conical straight flange area 14 and a subsequent cylindrical straight flange area 15 that terminates in the connecting contour 5.

Other exemplary embodiments not shown are provided either only with a frusto-conical straight flange area 14 or the knuckle area 3 is immediately followed by a cylindrical straight flange area 15. There are also embodiments where for example in the region of the first contour section 6 a frusto-conical straight flange area 14 is provided which makes a transition in the region of the second contour section to a cylindrical straight flange area 15 or vice versa.

The dish area 2 of the vessel head 1 is embossed with depressions 16 provided for handling the vessel or the vessel head 1 during manufacture. These may be provided with connectors (for example connecting bolts, threaded bolts etc.) in defined positions by means of which the vessel head 1 can be fixed in a defined position in a handling device.

In the base region a connection region 17 is formed comprising a connecting rim 18 the contour of which describes a plane circular cylinder section and serves to connect an obliquely cut-off connecting pipe 19 (indicated in dotted lines) which can be welded along the connecting rim 18. The connection region 17 is configured so that the connection base 20 extends in the same plane as does the base of the cylindrical straight flange area 15 or the cylindrical vessel ring 31 adjacent to the connecting contour 5 (see FIG. 5). This allows to realise an emptying of the entire vessel 30 without leaving residue. For connecting the connecting pipe 19 the circular metal blank disposed within the connecting rim 18 is cut out and the connecting pipe 19 is welded to the connecting rim 18. If no connecting pipe 19 is provided, then the connection region remains closed.

Figure 3:
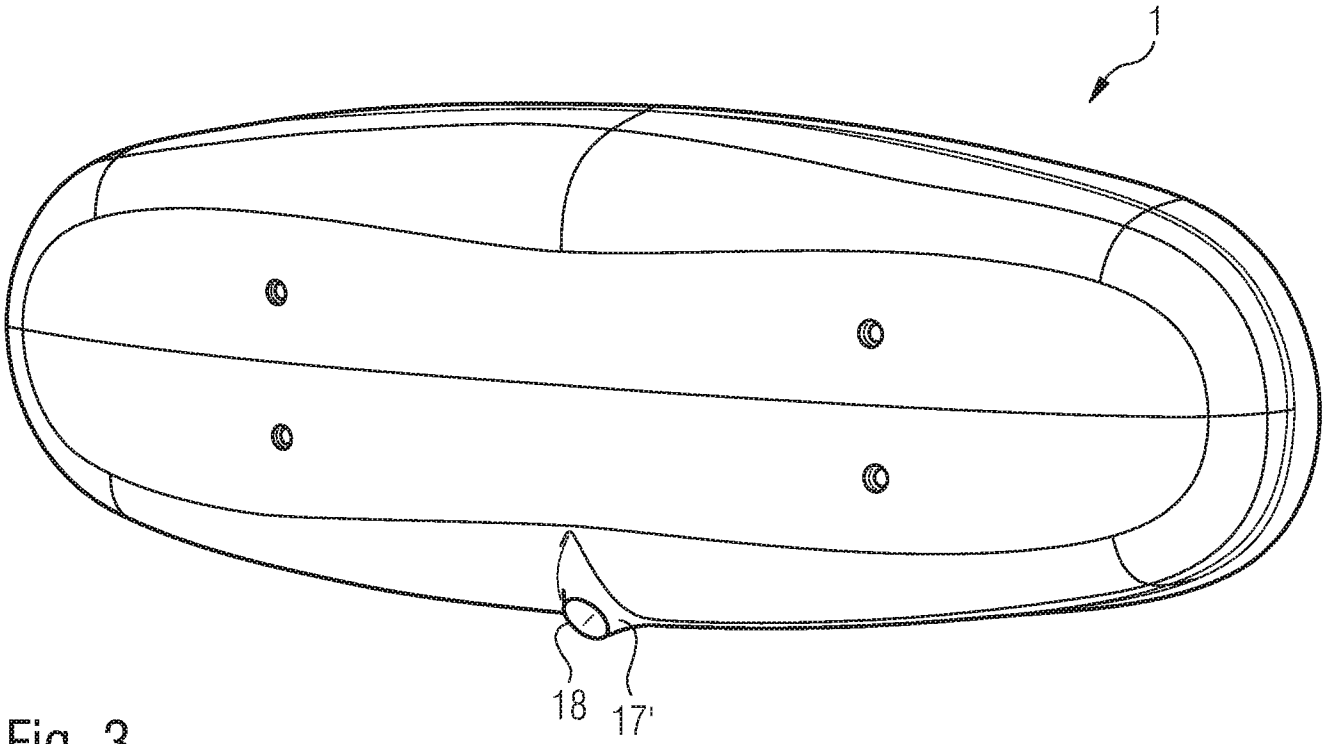
Figure 4:
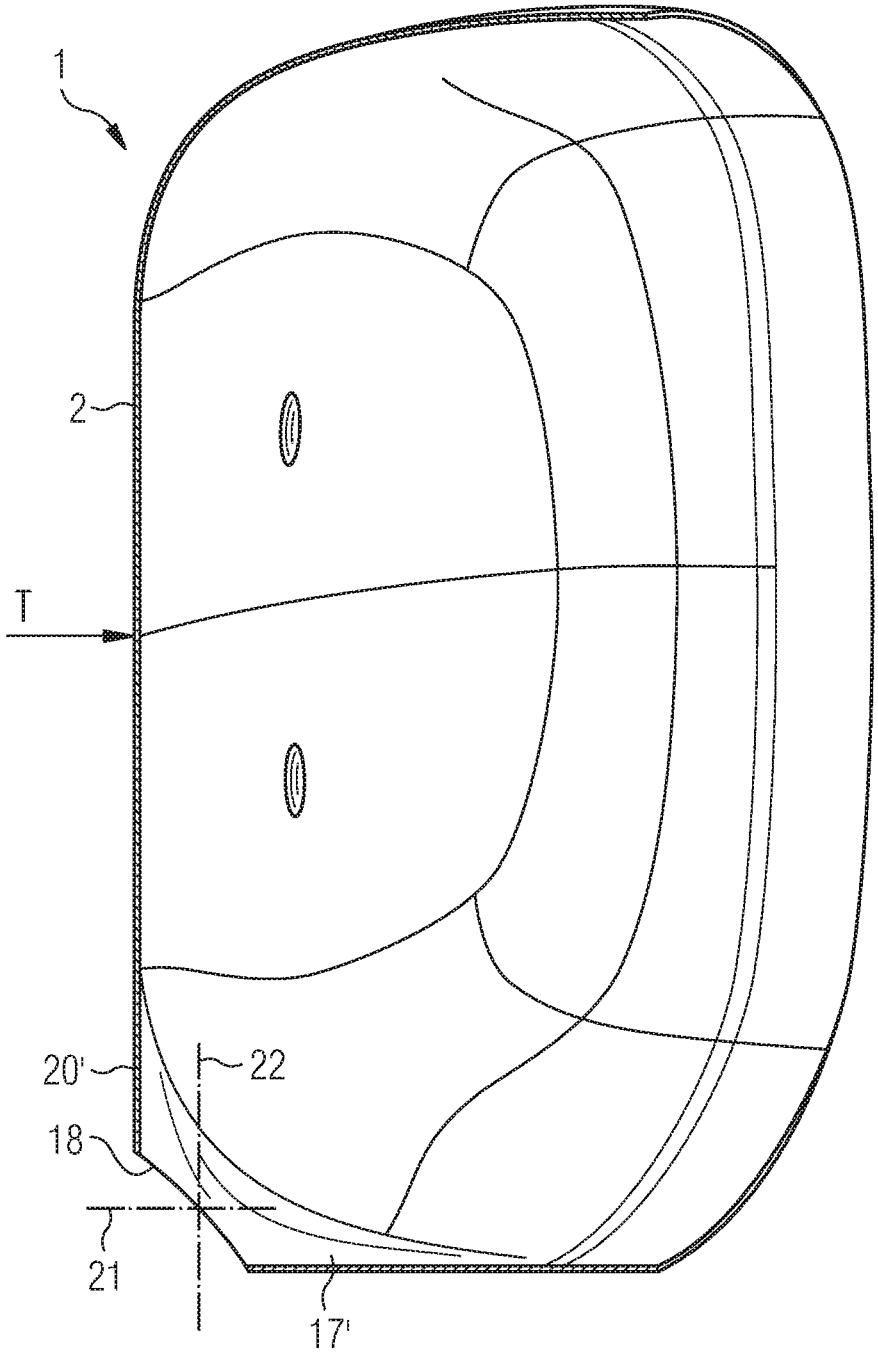
Figure 6:
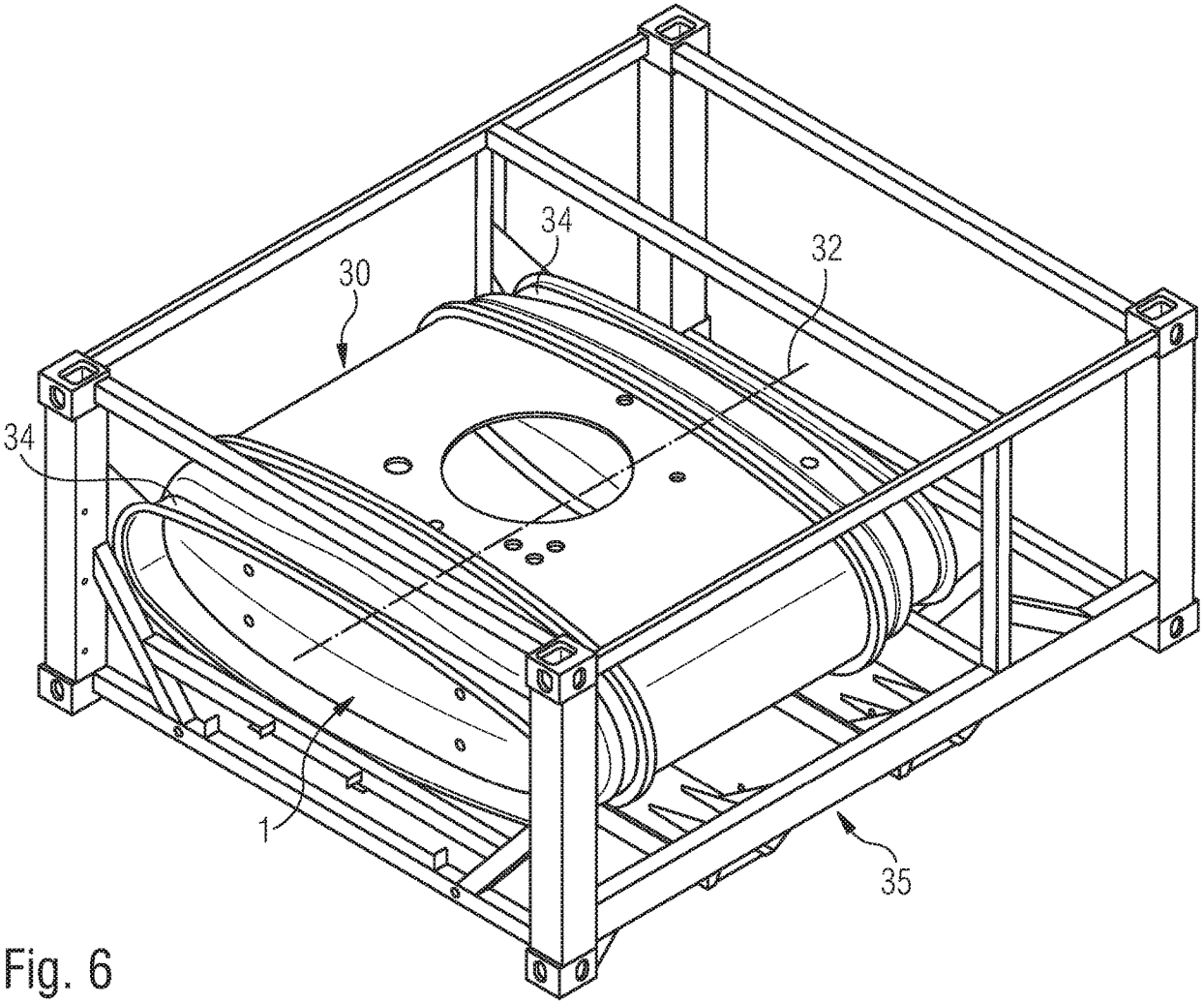

FIGS. 3 and 4 show a connection region 17' that is suitable both for an upright (see FIG. 6) and also a horizontal arrangement (see FIG. 7) of a vessel or the vessel head 1. This connection region 17' is configured so that it comprises a connecting base 20 extending in line with the vessel base, and a connecting base 20' which leads tangentially into the bottom point T of the dish area 2. The connection region 17' again terminates in a connecting rim 18 the contour of which corresponds to a straight cylinder section. Thus, this connection region 17' allows a discharge pipe to be connected along the pipe axis 21 (horizontal vessel, similar path as in FIG. 2) or in the alternative, along a pipe axis 22 (upright vessel as shown in FIG. 6 with the lowest vessel point lying in the bottom point T of the dish area 2). The connection regions 17, 17' are each optionally configured in the vessel head 1.

The following table indicates typical dimensions of a head 1 according to the invention having an oval cross-section:

| | |
|---|---|
| Vault radius R: | 4000 mm |
| first radius of curvature $r_1$: | 4000 mm |
| second radius of curvature $r_2$: | 260 mm |
| first knuckle radius $r_{1k1}$: | 160 mm |
| second knuckle radius $r_{1k2}$: | 80 mm |
| third knuckle radius $r_{2k3}$: | 80 mm |
| deformation depth T: | ~300 mm |
| long diameter $D_1$: | 2100 mm |
| short diameter $D_2$: | 700 mm |
| wall thickness s: | ~2 to 4 mm |

Figure 5:
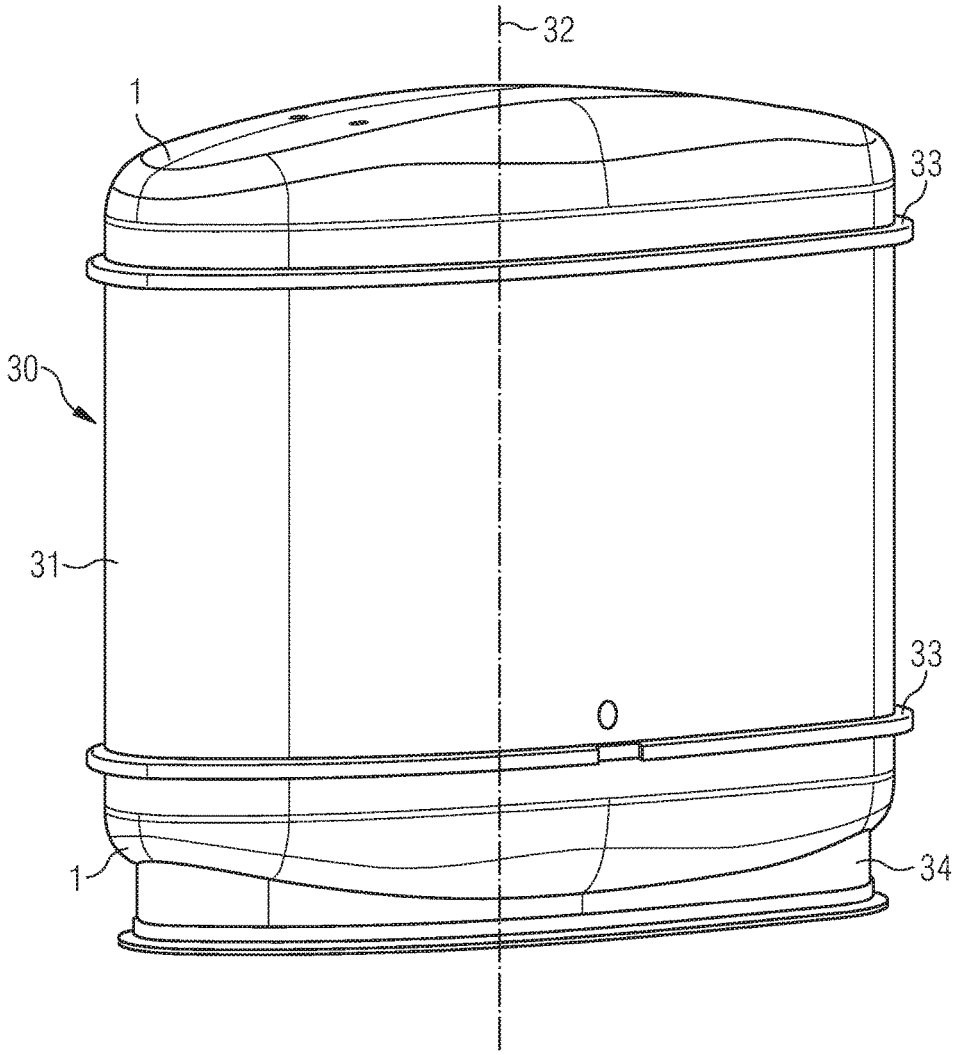

FIG. 5 shows a cylindrical vessel 30 comprising a cylindrical shell ring 31 matching the connecting contour 5 the top and head ends of which are closed with a vessel head 1. The two connecting contours of the vessel are each welded to the connecting contour 5 of the vessel heads 1 by means of a butt seam. In other embodiments the vessel head may be pushed into or onto the vessel ring 31. The connection is then established by way of one or two so-called fillet welds. FIG. 5 shows an upright vessel the longitudinal axis 32 of which extends in the vertical. For stabilising the vessel comprises two reinforcing rings 33 surrounding the vessel ring 31 with which they are welded. The lower vessel head 1 is connected with a ring base 34 which serves as a stand.

FIG. 6 shows a horizontal vessel arrangement which is also provided with a vessel 30 the longitudinal axis 32 of which extends in the horizontal. The vessel is connected by its ends via ring bases 34 with a frame structure 35. The frame structure 35 and the vessel 30 form a rank container unit suitable for transporting and storing liquids.

Figure 7:
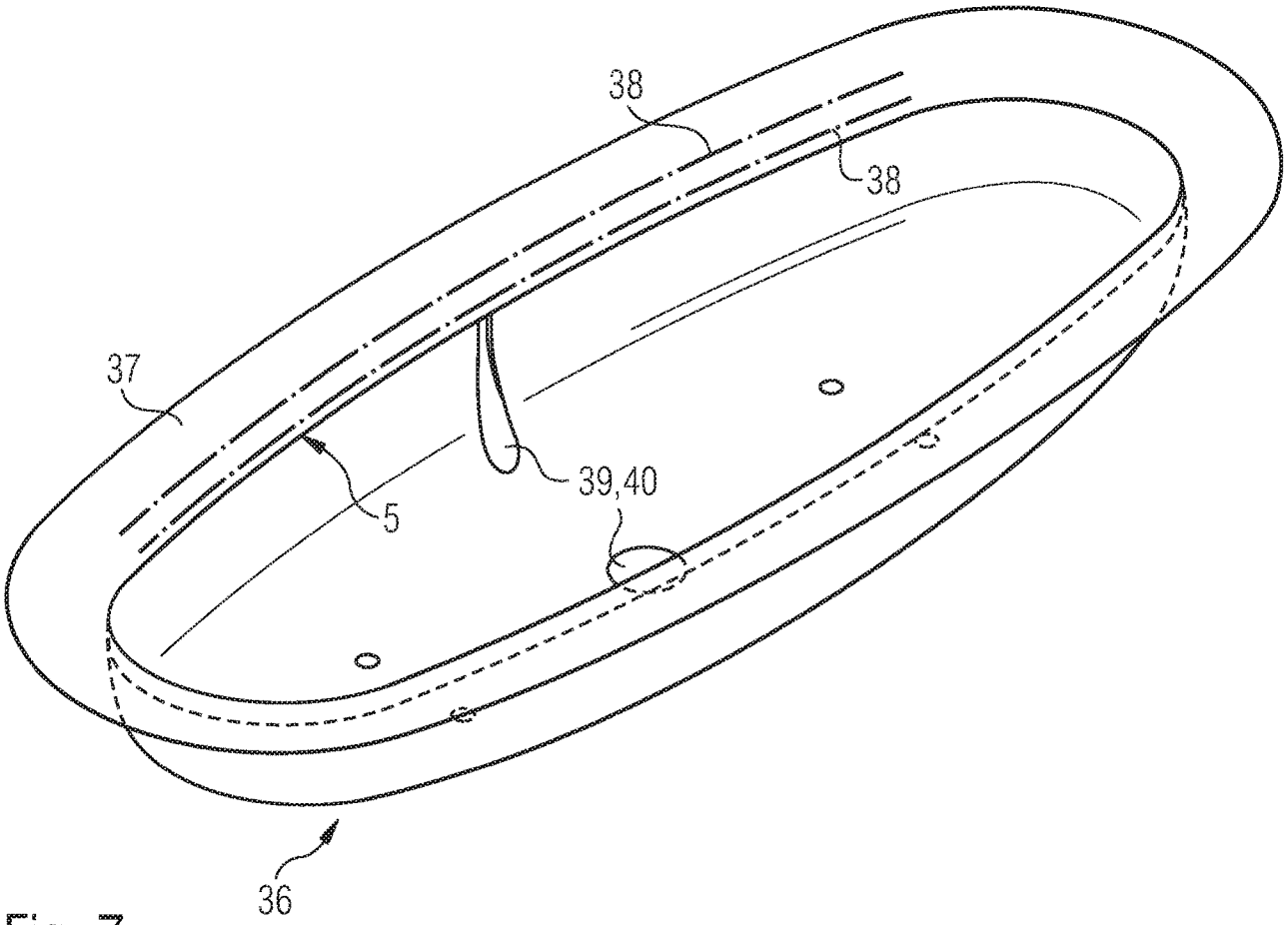

FIG. 7 shows a deep-drawing intermediate product 36 which is formed when manufacturing a vessel head 1 according to the invention. Starting out from a plane sheet metal blank (circular blank) it is deformed by means of a die corresponding to the internal shape of the vessel head 1. The rim 37 of the sheet blank is fixed onto a deep-drawing frame by means of a blank holder and the vessel head shape is formed by pressing the die into the sheet blank. To manufacture the final vessel head 1 the rim 37 remaining on the deep-drawing intermediate product 36 is then removed in one or more cutting processes along the cutting lines 38 so as to finally configure the connecting contour 5 at the vessel head 1. In the alternative to the connection regions described in conjunction with the FIGS. 2 and 4 shaped in the vessel head 1, manufacturing may also provide for contour cuts 39, 40 which are for example provided for connecting a pipe or fittings.

Figure 8:
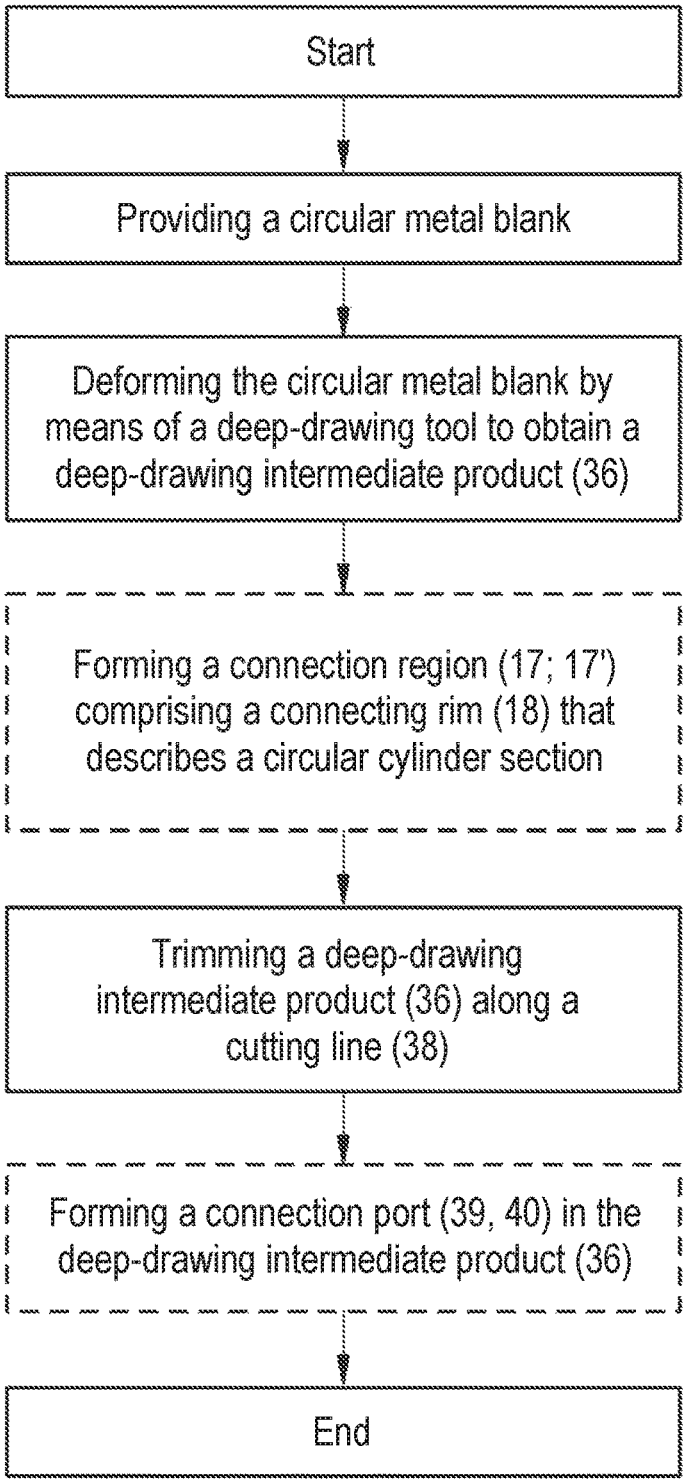

The method illustrated in FIG. 8 for manufacturing a vessel head 1 according to the invention basically proceeds in the following steps:

Providing a sheet metal blank, deforming the sheet metal blank by means of a deep-drawing tool to obtain a deep-drawing intermediate product 36 showing a vessel head geometry, trimming the deep-drawing intermediate product along a peripheral contour 38

Optionally one may provide the step of providing the deep-drawing intermediate product 36 with a connection port 39, 40. Embossing the depressions 16 or the connection regions 17/17' may take place either in the actual deep-drawing process while the vessel head 1 or the deep-drawing intermediate product 36 is shaped or in a second step in which the deep-drawing intermediate product 36 is processed with another embossing tool.

The invention claimed is:

1. A vessel head for a vessel, the vessel head comprising:

(a) a vaulted dish area having a vault radius (R);

(b) a connecting contour comprising:

(i) in a first contour section, a first radius of curvature ($r_1$), and (ii) in a second contour section, a second radius of curvature ($r_2$), wherein the first radius of curvature ($r_1$), is larger than the second radius of curvature ($r_2$); and (c) a knuckle area surrounding the dish area and tracing the connecting contour, wherein the knuckle area is disposed between the connecting contour and the dish area, and extends along the first contour section, and comprises:

(i) a first knuckle section having a first knuckle radius ($r_{1k1}$), and (ii) a second knuckle section having a second knuckle radius ($r_{1k2}$).

2. The vessel head according to claim 1, wherein the first knuckle section is disposed between two second knuckle sections and two transition sections, wherein each of the two transition sections is disposed between the first knuckle section and one of the two second knuckle sections, and wherein the first knuckle radius ($r_{1k1}$), makes a transition to the second knuckle radius ($r_{1k2}$).

3. The vessel head according to claim 2, wherein the first knuckle section, one of the second knuckle sections and one of the transition sections are configured to transition smoothly to each other.

4. The vessel head according to claim 1, further comprising a third knuckle section having a third knuckle radius ($r_{2k3}$), wherein the third knuckle section is disposed along the second contour section.

5. The vessel head according to claim 4, wherein a connection region is disposed in a region selected from the first knuckle section, one of the second knuckle sections, the third knuckle section and combinations thereof, wherein the connection region comprises a connecting rim defining a circular cylinder section.

6. The vessel head according to claim 1, wherein the first knuckle radius ($r_1$), is one and a half to three times the second knuckle radius ($r_2$).

7. The vessel head according to claim 1, wherein the first knuckle radius ($r_1$), is 1.8 to 2.5 times the second knuckle radius ($r_2$).

8. The vessel head according to claim 1, wherein the first knuckle radius ($r_1$), is two times the second knuckle radius ($r_2$).

9. The vessel head according to claim 1, wherein a ratio of the vault radius (R), to the first radius of curvature ($r_1$), is about 2.6:1 to about 1:1.

10. The vessel head according to claim 1, wherein a ratio of the vault radius (R), to the first radius of curvature ($r_1$), is 1.5:1 to 1:1.

11. The vessel head according to claim 1, wherein a ratio of the vault radius (R), to the first radius of curvature ($r_1$), is 1.2:1 to 1:1.

12. The vessel head according to claim 1, wherein a ratio of the first knuckle radius ($r_{1k1}$), to the vault radius (R), is 1:10 to 1:50.

13. The vessel head according to claim 1, wherein a ratio of the first knuckle radius ($r_{1k1}$), to the vault radius (R), is 1:20 to 1:30.

14. The vessel head according to claim 1, wherein a ratio of the first knuckle radius ($r_{1k1}$), to the vault radius (R), is 1:25.

15. The vessel head according to claim 1, wherein a flange area selected from a frusto-conical flange area, a cylindrical straight flange area and combinations thereof is disposed between the connecting contour and the knuckle area.

* * * * *